US007451588B2

(12) United States Patent
Badiali et al.

(10) Patent No.: US 7,451,588 B2
(45) Date of Patent: Nov. 18, 2008

(54) DRIVING SYSTEM FOR HIGH PRODUCTION OPEN-END SPINNING MACHINES

(75) Inventors: Roberto Badiali, Pordenone (IT); Vittorio Colussi, Cappella Maggiore, Treviso (IT); Renzo Del Bianco, Pordenone (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 20 days.

(21) Appl. No.: 11/698,474

(22) Filed: Jan. 26, 2007

(65) Prior Publication Data

US 2007/0204592 A1 Sep. 6, 2007

(30) Foreign Application Priority Data

Feb. 3, 2006 (IT) ..... MI2006A0193

(51) Int. Cl.
*D01H 4/14* (2006.01)

(52) U.S. Cl. ..... 57/404

(58) Field of Classification Search ..... 57/404–417
See application file for complete search history.

(56) References Cited

U.S. PATENT DOCUMENTS

| | | | | |
|---|---|---|---|---|
| 4,563,960 | A * | 1/1986 | Albrecht | 112/470.18 |
| 4,777,790 | A * | 10/1988 | Raasch | 57/263 |
| 5,706,642 | A * | 1/1998 | Haselwander | 57/264 |
| 6,209,866 | B1 * | 4/2001 | Hosking et al. | 271/228 |
| 6,336,752 | B1 * | 1/2002 | Balopole et al. | 396/459 |
| 6,337,525 | B1 * | 1/2002 | Bock et al. | 310/90 |
| 6,384,561 | B1 * | 5/2002 | Niizuma et al. | 318/625 |
| 6,773,090 | B2 * | 8/2004 | Baldwin-Garcia | 347/43 |
| 2007/0029863 | A1 * | 2/2007 | Haese et al. | 299/34.1 |
| 2007/0267274 | A1 * | 11/2007 | Steffen et al. | 198/689.1 |

* cited by examiner

*Primary Examiner*—Shaun R Hurley
(74) *Attorney, Agent, or Firm*—James V. Costigan; Hedman & Costigan, P.C.

(57) ABSTRACT

Driving system for open-end spinning machines, in particular of open-end spinning rotors, in which the power necessary for the driving of said rotors is distributed between two electric motors situated at the head and tail-end of the spinning machine, with a common belt transmission, the rotation of the tail-end motor being subordinate to the rotation of the motor at the head.

5 Claims, 3 Drawing Sheets

DRIVING SYSTEM FOR HIGH PRODUCTION OPEN-END SPINNING MACHINES

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1) Field of the Invention

The present invention relates to open-end spinning i.e. rotor spinning.

2)Description of Related Art

Open-end spinning machines generally consist of a series of individual spinning units, aligned on the two fronts of the machine, each of which consists of a spinning rotor, which produces twisted thread starting from the singularized fibres of a sliver, and a collection unit which—after controlling the quality of the yarn with the interpositioning at a slubcatcher between the two components—causes the yarn to be wound onto a tube to form a bobbin. This bobbin is thus formed by pulling and winding the yarn onto its surface, as it is pulled in rotation by the underlying roll on which the rotating bobbin in formation is resting. The yarn is spirally wound onto the rotating bobbin as the collection unit is provided with a thread-guide device which distributes the yarn with a backward and forward axial movement onto the outer surface of the bobbin.

The structure of the individual spinning station is illustrated in the scheme of FIG. 1, and its functioning is briefly described hereunder according to its normal operating mode.

Proceeding upwards, the single spinning station 1 consists of an actual spinning unit 2 and a collection unit 3, of which the main components which lead to the transformation of the sliver of parallelized fibres to the bobbin of wound yarn, are briefly illustrated below.

The feeding tape or sliver S is contained in a cylindrical vase 4 which is deposited with a double spiral. The sliver S is fed to the unit by a feeding roll 5 passing through the funnel-shaped conveyor 6 and reaches the card 7, a rotating roll equipped with a toothed washer which singularizes the fibres of the sliver S and sends them by suction to the spinning rotor 8, which operates in depression.

The singularized fibres are deposited by a centrifugal effect in the peripheral throat of the spinning rotor 8, which rotates at very high velocities (up to 150,000 revs/minute and over); from here they are collected and removed in the form of the thread F, axially leaving its central opening 9, receiving torsions by the rotation of the rotor itself in the course which runs between its internal throat and said opening 9, thus creating the twisted thread F.

The pulling of the thread is effected with a pair of opposite extraction cylinders 11 and 12 which seize the thread F and are driven at a controlled rate according to the arrow a, thus causing the linear production of yarn, generally indicated in m/min. The quality-control sliver 14 of the yarn F can be positioned before the cylinders 11/12.

The thread F thus produced enters the collection unit 3, passes through a thread-presence sensor 15 and encounters a compensator 16 for compensating the variations in length of the run between the spinning unit 2 and the depositing point of the yarn F on the bobbin. The thread-guide device 21 distributes the thread on the bobbin in formation by transversally moving with a backward and forward movement according to the double arrow b, activated by a motor 20 which drives a longitudinal rod 22 in common with the other units of the spinning machine.

The bobbin 25 collects the thread F and is held by the bobbin-holder 26 equipped with two idle and openable counterpoints 27 which become engaged with the base tube 28 of the bobbin. The bobbin in formation 25 is laid on its driving roll or collection cylinder 29.

Open-end spinning machines typically consist of a large number of open-end spinning units aligned on the two fronts of the machine, each equipped with driving units in common with the spinning units arranged on each front and in particular the organs cited above:

feeding rolls 5
card 7
spinning rotors 8
extraction cylinders 11/12
thread-guide device 21
collection cylinder 29

Apart from the thread-guides 21, which are activated in an alternating backward-and-forward movement, the other organs are activated in rotation with motors in common by means of transmissions which run along the front of the machine and which transmit their movement to the rotating organ of each spinning unit.

The scheme of the movement transmission system—in a conventional open-end spinning machine—is described herein with reference to FIG. 2, with specific illustrative reference to the driving of spinning rotors 8 aligned on one of the two fronts of the machine, with the specification that the driving of the other rotating organs, for example the cards 7, can be analogous to that of the spinning rotors and that the present invention can also be advantageously applied for other rotating activations of open-end spinning machines.

With respect to other open-end spinning organs, the activation of the spinning rotors is that which has the most technical problems in view of the high velocity, power and tension values to which the transmission belt which activates the rotors of a whole spinning front, is subjected.

In the top-end of the spinning machine, the common driving units of the various organs of the single spinning units are positioned together with the drive and control organs of the spinning machine. As far as the spinning rotors are concerned, the supporting structure of the machine, not indicated in the figure, sustains the asynchronous electric driving motor 31, which transmits movement with the transmission belt 32 to the pulley 33, which is smaller and coaxial with respect to the main pulley 34, thus multiplying the linear velocity transmitted on the basis of the ratio of the diameters $ø_{34}/ø_{33}$. The driving belt 35 of the rotors winds the main pulley 34 by about 180° and reaches the idle counter-pulley 37. A rotation detector 38, for example with a probe disk, commonly called encoder, is situated on this counter-pulley, which allows the control unit of the spinning machine to detect the rotation rate of the pulley 37 corresponding to the linear rate of the rotor driving belt 35. On the basis of the values detected by the encoder, the control unit 39 of the machine controls and drives the asynchronous motor 31, to give the main pulley 34 the desired rotation rate, with a variable frequency current generator 40, commonly called inverter.

The belt 35 runs horizontally from the idle pulley 37 along the whole front of the spinning machine as far as the tail-end of the spinning machine with the upper branch of its run. Along its upper run the belt 35 encounters one or more idle supporting rolls 41 which keep it lifted to the desired level.

At the tail-end of the spinning machine, there are two tail levelling and counter-pulleys 43, 44 which allow the belt 35 to invert its run and return with the lower branch of its course defined by the counter-pulleys 44, 45.

On the lower branch of its run, the belt 35—as better illustrated in the enlarged detail—encounters the legs 47 of the spinning rotors, on which it rests tangentially and to which it transmits the rotation torque to said rotors, rotating them at the required rate, which can reach 150,000 revs per minute. On its lower run, the belt 35 also encounters a series of thread-tensioner guide pulleys 48, consisting of idler pulleys, opposite and slightly offset with respect to the rotor legs 47, which push the belt itself with a pre-established force F against said legs of the rotors.

Recently designed automatic open-end spinning machines are constructed for high productions by aligning on each front of the machine an increasing number of spinning units, reaching and exceeding two-hundred units for each front.

The front encumbrance of each spinning unit is in the order of 250 mm, as also the pitch s between the spinning rotors shown in FIG. 2. The installation—for example—of two-hundred units on each front leads to a length of the spinning machine of over 50 metres and with lengths of the transmission belt well over 100 metres, taking into account the driving and control top-ends which are envisaged for spinning machines and the necessary driving transmissions.

At current rotation regimes of the rotors, the performances required to the transmission belt are extremely severe. Its linear rate is in the order of 55-75 m/sec, its positioning tension from standstill is in the order of 700-950 N, the overall absorbed power per rotor is in the order of 120-180 W. A significant part of the power required can be attributed to the energy consumed for the flexural and tensional mechanical stress cycles to which the transmission belt is subjected in its run along its closed circuit: this energy results in the heating of the belt itself, in the reduction of its friction coefficient and transmittable power, in addition to a progressive deterioration in its mechanical characteristics. For these reasons, thin transmission belts are adopted, with a small transversal section and well stretched, having a rigidity which is as limited as possible to reduce the amount of energy dispersed for the flexure which is caused in their heating.

In its closed circuit movement, the transmission belt is less tense in its upper run and more tense in its lower run, along which it transmits the rotation torque to the legs 47 of the rotors and overcomes their resistance torque. In its circuiting, the belt 35 is periodically more or less tightened between the terminal pulleys.

The transmission belt 35 is already assembled with a considerable positioning tension, to ensure that during its run it is never slowed down, not even in its upper course. When operating, in its lower run the tension of the belt gradually increases to overcome the resistance torque of the rotor legs aligned along the machine. At each rotor activated, the tension increase on the belt is in the order of 2-4 N, and the resistant torque is in the order of 0,15-0,3 Nm, depending on the geometries and rates.

With an increase in the number of open-end spinning units aligned on each of the fronts of the machine, the power and driving torque to be transmitted to the driving system with the main pulley 34, consequently also increase within the approximately 180° of its winding on the part of the belt 35. With an increase in the number of spinning units, there is therefore a limit to the power and torque which can be transmitted with the main pulley, taking into account the flexibility and dimensional requisites typical for the driving of open-end spinning machines. Close to these limits, there is slippage and malfunctioning, especially when the friction coefficients between the belt and pulley begin to deteriorate.

Analogously, with an increase in the number of spinning units per machine front, the increase in tension of the belt between the tail-end pulley 44 and the main pulley 34 which drives the activation, is also greater. For 200 spinning units for each front of the spinning machine, the tension acting on the belt in correspondence with the main pulley 34 can reach values of even 1200-1500 N.

The driving system of open-end spinning machines according to the invention is defined in the first claim for its essential components, whereas its variants and preferred embodiments are specified and defined in the subsequent dependent claims.

BRIEF SUMMARY OF THE INVENTION

In order to better illustrate the problems faced and technical solutions proposed with the present invention, reference is therefore made in the following description to a driving scheme of the rotors of an open-end spinning machine according to the invention, for illustrative and non-limiting purposes, with the specific indication that it can also be advantageously used for the driving of different groups and organs within the same open-end spinning machine.

DETAILED DESCRIPTION OF THE INVENTION

According to the present invention, the power necessary for the driving of the spinning rotors is distributed between the two electric motors situated at the top-end and tail-end of the spinning machine.

Figure 1:
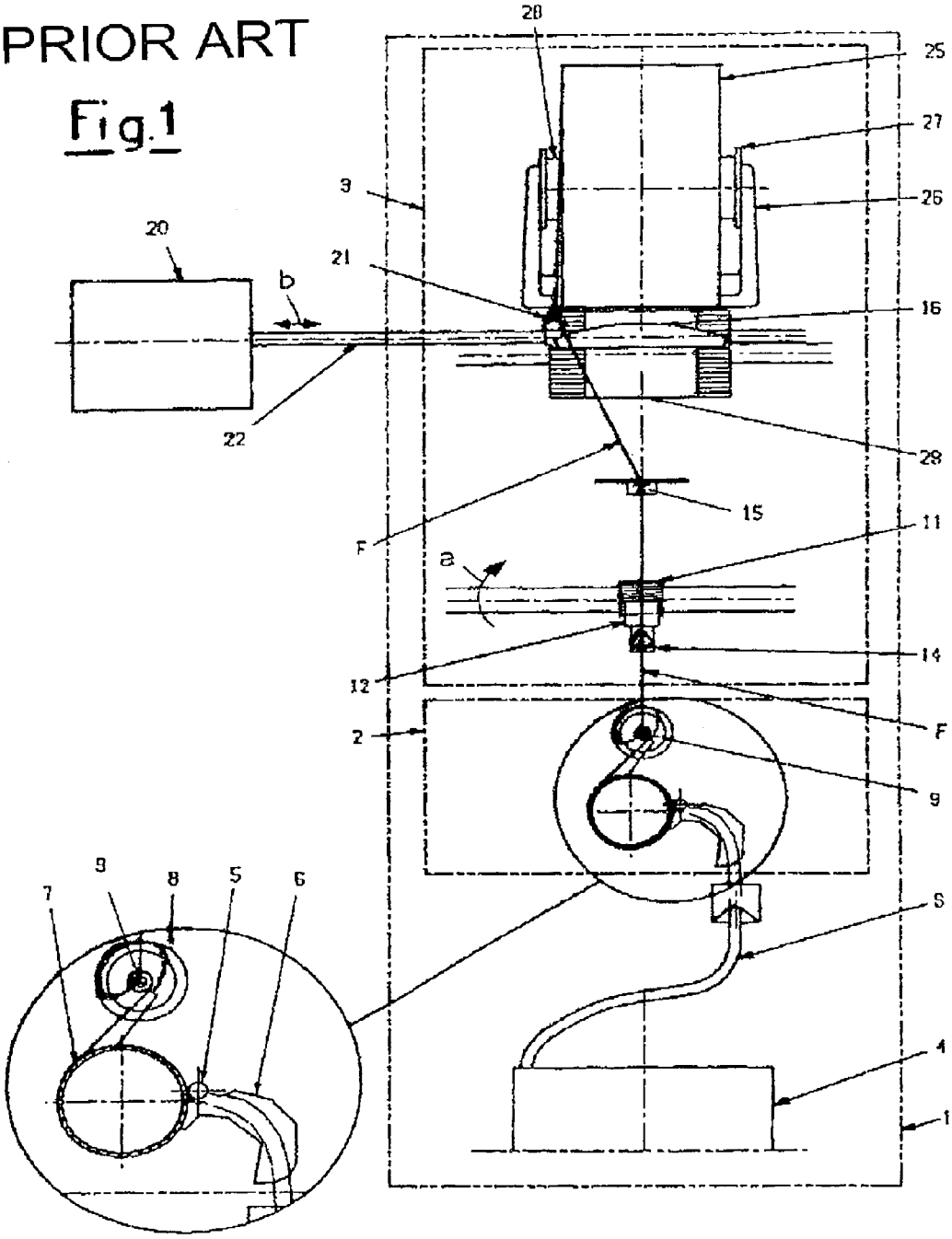
PRIOR ART Fig.1
FIG. 1 illustrates the scheme of an open-end spinning unit in its most significant components.
Figure 2:
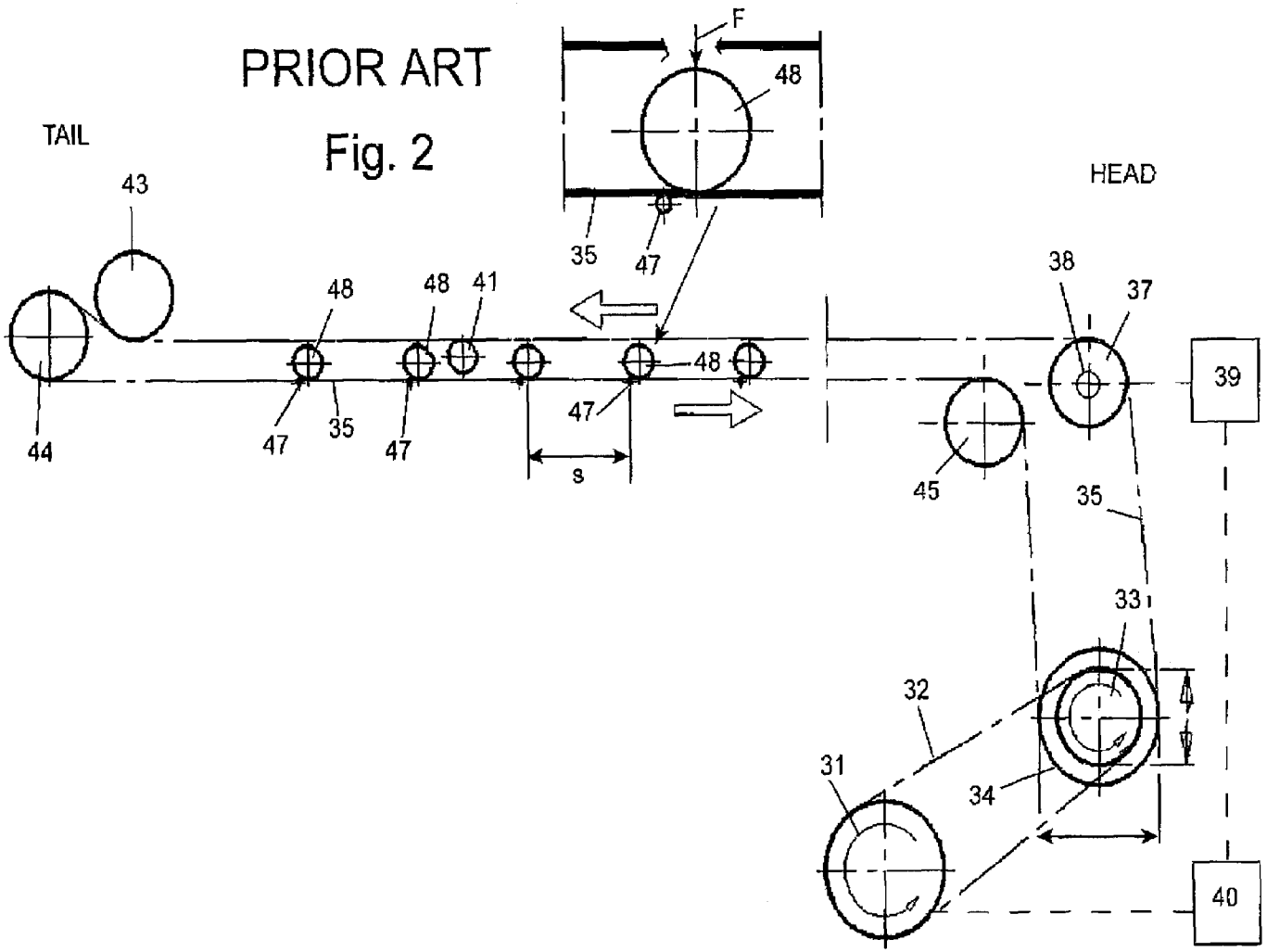
PRIOR ART Fig. 2
FIG. 2 shows a driving scheme of the rotors of an open-end spinning machine of the conventional type, to illustrate its problems and technical limits.

Analogously to the scheme of FIG. 2, an asynchronous electric driving motor 51 is situated at the top-end of the spinning machine, which generally provides a power equal to half of the overall power required by the spinning motors. The motor 51 transmits movement with the transmission belt 52 to the pulley 53, which is smaller and coaxial with respect to the main pulley 54. Analogously to the scheme of FIG. 2, there is the multiplying effect of the linear rate transmitted on the basis of the ratio of the diameters of the two pulleys $ø_{54}/ø_{53}$.

The driving belt 55 of the rotors, downstream of the main pulley 54, reaches the idle drive pulley 57 which acts as a reference pulley for the whole activation. Analogously to the scheme of FIG. 2, an encoder 58 is situated on the reference pulley 57, which allows the control unit 59 of the spinning machine to indicate the linear rate of the driving belt 55 of the rotors.

On the basis of the values indicated by the encoder 58, the control unit 59 of the machine—by means of the inverter 60—controls and drives both the asynchronous motor 51, situated at the top-end and also the asynchronous motor 51', situated at the tail-end of the spinning machine. The driving inverter 60 of the asynchronous motor 51 at the top-end is in fact connected with the driving inverter 60' of the asynchronous motor 51' at the tail-end with a so-called "syncro master slave" line 62, i.e. a transmission line of an impulse synchronism signal between the two inverters 60, 60' which drive the motors 51, 51', the rotation of the motor 51' being subordinate to the rotation of the motor 51.

The belt 55 runs horizontally from the idle pulley 57, along the whole front of the spinning machine as far as the tail-end of the spinning machine with the upper branch of its run. Along its upper run, the belt 55 encounters one or more idle supporting pulleys 61 which keep it lifted to the desired level.

The activation scheme at the top-end is repeated at the tail-end of the spinning machine in absolute symmetry.

A second asynchronous electric driving motor 51' is positioned at the tail-end of the spinning machine, which generally also provides a power equal to half of the overall power required by the spinning rotors. The motor 51' transmits movement with the transmission belt 52' to the pulley 53' and the subordinated pulley 54'.

When the driving belt 55 of the rotors has completed its upper run, it reaches the idle counter-pulley 57' and arrives at the subordinated driving pulley 54'.

The belt 55 receives the power of the motor 51' and reaches its lower course, inverting its movement in the lower branch of its run defined by the counter-pulleys 64, 65.

Completely analogously to the scheme of FIG. 2, on the lower branch of its run, the belt 55 encounters the legs 67 of the spinning rotors, to which it transmits the rotation torque. On said lower run, the belt 55 again encounters the thread-tensioner guide pulleys 68, which push the belt itself with a pre-established force F against said rotor legs.

Figure 3:
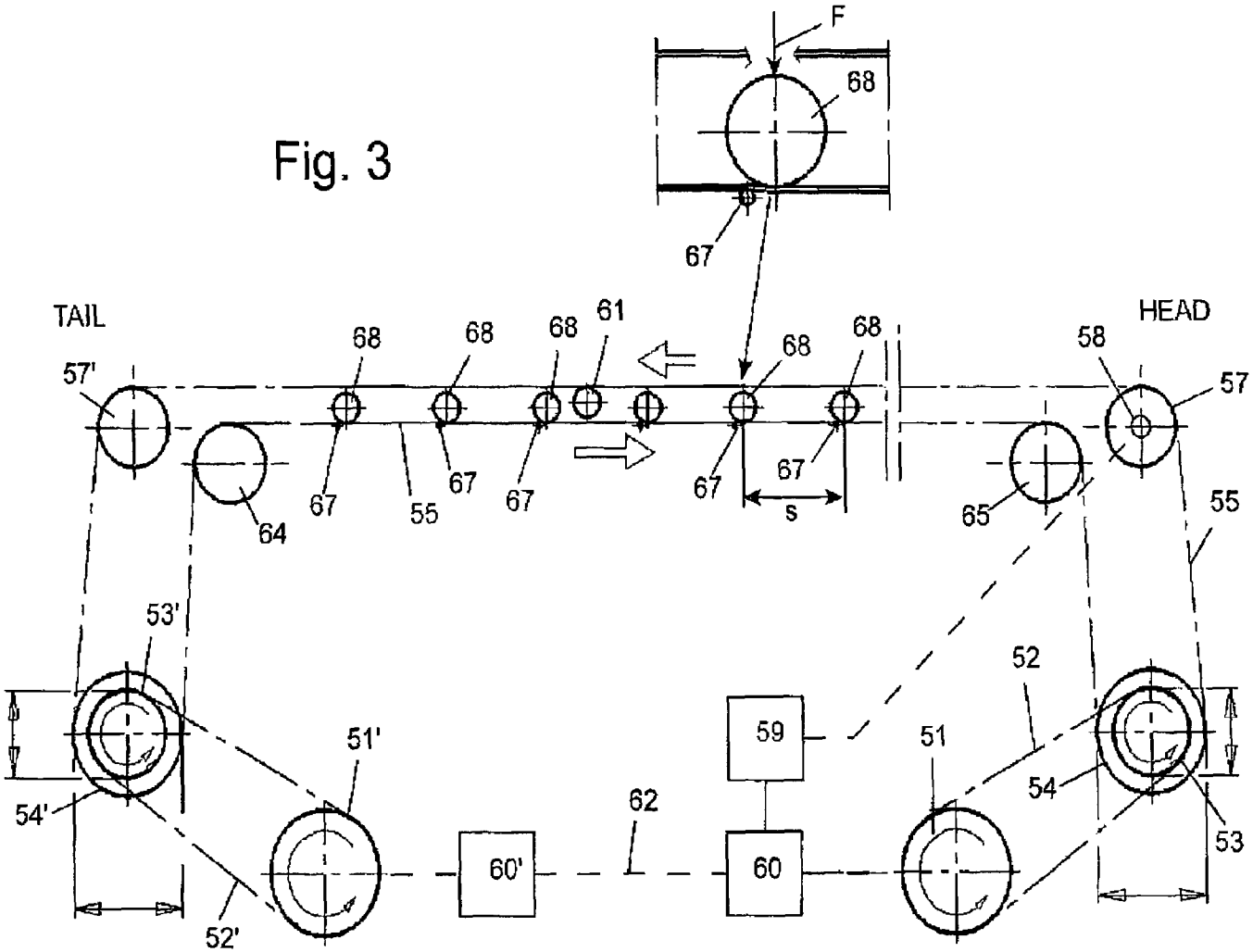
With reference to FIG. 3, this illustrates the driving scheme of the rotors of an open-end spinning machine according to the invention.

The driving system of open-end spinning machines according to the invention, as illustratively described with reference to FIG. 3, provide considerable advantages with respect to the scheme of FIG. 2 according to the known art. Among these the following improvements are worth mentioning. Considerable progress has been made with respect to the driving and stress efficiency on the various organs.

In general, and without malfunctioning, the two motors 51, 51', distribute 50% of the load, but if one of these tends to slow down its rate, the common transmission with the belt 55 allows the other motor to "pull" to re-establish the normal course of the belt tensions, thus rebalancing the resistance torques which are causing the slow-down and allowing the slower motor to return to synchronism.

With the same transmitted power and number of activated units, and also with the same geometries and operating parameters, the driving distribution of the two subordinated motors synchronized with each other allows the tensions on the driving belt to be reduced. Under the various operating conditions and positioning tensions of the belt, this reduction is in the order of 10-25% with respect to the maximum tension exerted on the belt when operating, whereas as far as the average tension is concerned, the reduction is in the order of 15-30%.

Again under the same conditions, the transmittable power—with the double-motor driving system according to the invention—is substantially doubled and it is therefore possible to double the number of spinning units per front of the spinning machine, with the same margin of safety with respect to slippages of the same driving system.

The invention claimed is:

1. A driving system for open-end spinning machines, in particular of the rotors (8) of a front of an open-end spinning machine, characterized in that the power necessary for the driving of the spinning rotors is distributed between two electric motors (51, 51') respectively situated at the top-end (51) and tail-end (51') of the spinning machine, by transmission by means of a common driving belt (55) of the rotors (8), the rotation of the motor (51') being subordinated to the rotation of the motor (51) wherein downstream of the main pulley (54) moved by the motor (51) at the top-end, the belt (55) reaches the idle reference pulley (57) for the whole driving, an encoder (58) being positioned thereon, for indicating the linear rate of the driving belt (55) of the rotors, and on the basis of the values indicated by the encoder (58), the control unit (59) of the machine controls and drives both the motor (51) at the top-end and also the motor (51') situated at the tail-end of the spinning machine.

2. The driving system for open-end spinning machines according to claim 1, characterized in that the motors (51, 51') are asynchronous electric motors and are controlled and driven by the control unit (59) of the machine by means of the inverters (60, 60').

3. The driving system for open-end spinning machines according to claim 1, characterized in that the driving inverter (60) of the asynchronous motor (51) at the top-end is in fact connected with the driving inverter (60') of the asynchronous motor (51') at the tail-end with a transmission line (62) of an impulse synchronism signal between the two inverters (60, 60') which drive. the motors (51, 51'), the rotation of the motor (51') being subordinate to the rotation of the motor (51)

4. The driving system for open-end spinning machines according to claim 1, characterized in that on the lower branch of its run, the belt (55) transmits the rotation torque to the legs (67) of the spinning rotors (8) intervalled by thread-tensioner guide pulleys (68).

5. The driving system for open-end spinning machines according to claim 1, characterized in that the common transmission to the belt is used for the driving of the cards (7).

* * * * *